US010074327B2

(12) United States Patent
Seo et al.

(10) Patent No.: US 10,074,327 B2
(45) Date of Patent: Sep. 11, 2018

(54) DISPLAY APPARATUS AND METHOD OF DRIVING THE SAME

(71) Applicant: SAMSUNG DISPLAY CO., LTD., Yongin-si, Gyeonggi-Do (KR)

(72) Inventors: Ji-Myoung Seo, Hwaseong-si (KR); Dong-Won Park, Hwaseong-si (KR); Jae-Wan Park, Seoul (KR); Sang-Mi Kim, Yongin-si (KR); Yong-Doo Park, Jeonju-si (KR); Kyoung-Won Lee, Seoul (KR); Joon-Chul Goh, Hwaseong-si (KR); Bonghyun You, Seongnam-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 97 days.

(21) Appl. No.: 15/060,011

(22) Filed: Mar. 3, 2016

(65) Prior Publication Data

US 2017/0047028 A1 Feb. 16, 2017

(30) Foreign Application Priority Data

Aug. 13, 2015 (KR) ..... 10-2015-0114905

(51) Int. Cl.
*G09G 3/36* (2006.01)

(52) U.S. Cl.
CPC ..... *G09G 3/3648* (2013.01); *G09G 3/3614* (2013.01); *G09G 2310/08* (2013.01); *G09G 2320/103* (2013.01); *G09G 2330/021* (2013.01); *G09G 2340/0435* (2013.01)

(58) Field of Classification Search
CPC ..... G09G 3/3648; G09G 3/3614; G09G 2340/0435; G09G 2320/103; G09G 2330/021; G09G 2310/08
See application file for complete search history.

(56) References Cited

U.S. PATENT DOCUMENTS

2003/0112213 A1* 6/2003 Noguchi ..... G09G 3/3614 345/96
2015/0145900 A1* 5/2015 Lee ..... G09G 3/3648 345/691

FOREIGN PATENT DOCUMENTS

KR 1020140076252 6/2014

* cited by examiner

*Primary Examiner* — Charles Hicks
(74) *Attorney, Agent, or Firm* — F. Chau & Associates, LLC

(57) ABSTRACT

A display apparatus includes a mode determiner configured to compare image signals of a previous frame and a current frame and to determine an image mode of the current frame, a sync signal generator configured to generate a panel sync signal with a low frequency corresponding to the image mode using an original sync signal with a normal frequency, the low frequency being a non-divisor frequency of the normal frequency and lower than the normal frequency, a data driver configured to drive a data line of a display panel using a data sync signal based on the panel sync signal with the low frequency, and a gate driver configured to drive a gate line of the display panel using a gate sync signal based on the panel sync signal with the low frequency.

16 Claims, 7 Drawing Sheets

< FIRST LOW-FREQUENCY IMAGE MODE >

DISPLAY APPARATUS AND METHOD OF DRIVING THE SAME

CROSS-REFERENCE TO RELATED APPLICATION

This application claims priority from and the benefit of Korean Patent Application No. 10-2015-0114905 filed on Aug. 13, 2015, which is hereby incorporated by reference for all purposes as if fully set forth herein.

TECHNICAL FIELD

Exemplary embodiments of the inventive concept relate to a display apparatus and a method of driving the display apparatus. More particularly, exemplary embodiments of the inventive concept relate to a display apparatus for high display quality and a method of driving the display apparatus.

DISCUSSION OF RELATED ART

In general, a liquid crystal display ("LCD") apparatus includes an LCD panel and a driver driving the LCD panel. The LCD panel includes a plurality of data lines, a plurality of gate lines crossing the plurality of data lines, and a plurality of pixels connected to the data lines and the gate lines.

The driver includes a gate driving circuit which outputs a gate signal to a gate line and a data driving circuit which outputs a data signal to a data line. The driver drives the LCD panel with a driving frequency.

The driving frequency of the driver may be preset and unrelated to an image type displayed on the LCD panel. Generally, the driver drives the LCD panel with the driving frequency of 60 Hz to display an image on the LCD panel. The driver drives the LCD panel with the driving frequency of 60 Hz to display a static image as well as a moving image on the LCD panel. Therefore, power consumption of the LCD panel while displaying the static image may be higher than necessary.

SUMMARY

Exemplary embodiments of the inventive concept provide a display apparatus for driving with various low-frequencies.

Exemplary embodiments of the inventive concept provide a method of driving the display apparatus.

According to an exemplary embodiment of the inventive concept, there is provided a display apparatus. The display apparatus includes a mode determiner configured to compare image signals of a previous frame and a current frame and to determine an image mode of the current frame, a sync signal generator configured to generate a panel sync signal with a low frequency corresponding to the image mode using an original sync signal with a normal frequency, the low frequency being a non-divisor frequency of the normal frequency and lower than the normal frequency, a data driver configured to drive a data line of a display panel using a data sync signal based on the panel sync signal with the low frequency, and a gate driver configured to drive a gate line of the display panel using a gate sync signal based on the panel sync signal with the low frequency.

In an exemplary embodiment, the sync signal generator may be configured to generate a vertical sync signal with the low frequency based on a vertical sync signal with the normal frequency, and the vertical sync signal with the low frequency may have a first frame period and a second frame period different from the first frame period.

In an exemplary embodiment, the first frame period and the second frame period may have an active period substantially the same as each other and a vertical blanking period different from each other.

In an exemplary embodiment, the sync signal generator may be configured to generate a low-frequency data enable signal activated respectively corresponding to the active period of the first and second frames.

In an exemplary embodiment, the sync signal generator may be configured to generate a reference vertical sync signal having a first starting pulse corresponding to the first frame period and a second starting pulse corresponding to the second frame period, and to generate a low-frequency vertical starting signal having a first starting pulse and a second starting pulse, one of the first and second starting pulses of the low-frequency vertical starting signal shifted from a corresponding pulse of the reference vertical sync signal.

In an exemplary embodiment, the first and second starting pulses of the low-frequency vertical starting signal may be repeated by a substantially same period as each other.

In an exemplary embodiment, the gate driver may start an operation in response to the low-frequency vertical starting signal.

In an exemplary embodiment, the low-frequency vertical sync signal may have the first frame period and the second frame period, and the first and second frame periods are repeated in an order as the first, second, second and first frame periods.

In an exemplary embodiment, the data driver may be configured to output a data voltage which swings between a positive polarity and a negative polarity opposite to the positive polarity with respect to a reference voltage.

According to an exemplary embodiment of the inventive concept, there is provided a method of driving a display apparatus. The method includes determining an image mode of the current frame using image signals of a previous frame and a current frame, generating a panel sync signal with a low frequency corresponding to the image mode using an original sync signal with a normal frequency, the low frequency being a non-divisor frequency of the normal frequency and being lower than the normal frequency, driving a data line of a display panel using a data sync signal based on the panel sync signal with the low frequency, and driving a gate line of the display panel using a gate sync signal based on the panel sync signal with the low frequency.

In an exemplary embodiment, the method may further include generating a vertical sync signal with the low frequency based on a vertical sync signal with the normal frequency, wherein the vertical sync signal with the low frequency may have a first frame period and a second frame period different from the first frame period.

In an exemplary embodiment, the first frame period and the second frame period may have an active period same as each other and a vertical blanking period different from each other.

In an exemplary embodiment, the sync signal generator may be configured to generate a low-frequency data enable signal activated respectively corresponding to the active period of the first and second frames.

In an exemplary embodiment, the method may further include generating a reference vertical sync signal having a first starting pulse corresponding to the first frame period and a second starting pulse corresponding to the second frame period, and generating a low-frequency vertical starting signal having a first starting pulse and a second starting pulse, one of the first and second starting pulses of the low-frequency vertical starting signal shifted from a corresponding pulse of the reference vertical sync signal.

In an exemplary embodiment, the first and second starting pulses of the low-frequency vertical starting signal may be repeated by a substantially same period.

In an exemplary embodiment, the low-frequency vertical sync signal may have the first frame period and the second frame period, and the first and second frame periods are repeated in an order as the first, second, second and first frame periods.

In an exemplary embodiment, the method may further include outputting a data voltage which swings between a positive polarity and a negative polarity opposite to the positive polarity with respect to a reference voltage, to the data line.

According to the inventive concept, the display apparatus is configured to generate a non-divisor frequency, which is not a divisor frequency of the normal frequency of the original sync signal and is lower than the normal frequency. Thus, the display apparatus may be configured to generate a low-frequency sync signal with a suitable low frequency corresponding to a type of the static image. In addition, when the low-frequency sync signal includes a plurality of frame periods having difference period from each other, the display apparatus is configured to generate the vertical starting signal having a regular interval between starting pulses. Thus, a charging period difference may be compensated between data voltages of positive and negative polarities according to a difference between the frame periods. Alternatively, the charging-period difference between data voltages of positive and negative polarities may be compensated by controlling an arrangement of the plurality of frame periods according to a frame inversion mode.

According to an exemplary embodiment of the inventive concept, a timing controller for a display apparatus includes an image data input configured to receive a plurality of original image frames; a memory coupled to the image data input; a mode determiner coupled to the memory and configured to receive present frame image data from at least one of the image data input or the memory, retrieve previous frame image data from the memory, compare the present frame image data with the previous frame image data to determine whether one of a plurality of low frequencies is achievable, and generate mode information indicative of a low frequency corresponding to the substantially lowest achievable frequency of the plurality of low frequencies; and a sync signal generator connected to the mode determiner and configured to receive the mode information, generate at least one of a start signal or a data enable signal, and output the at least one generated signal.

In an exemplary embodiment, the timing controller further includes at least one of a synchronization signal input or a data enable signal input coupled to the sync signal generator.

In an exemplary embodiment of the timing controller, the image data input is configured to receive original image data having an original frame frequency, the mode determiner is configured to generate mode information indicative of a low frequency corresponding to a frame frequency lower than the original frame frequency, where the original frame frequency may be unequally divisible by the low frequency, and the sync signal generator is configured to generate a synchronization signal corresponding to the low frequency by at least one of adjusting a start time of one of a plurality of alternating sub-frames within each frame or inverting an order of alternating sub-frames within each frame.

BRIEF DESCRIPTION OF THE DRAWINGS

The above and other features of the inventive concept will become more apparent by describing in detail exemplary embodiments thereof with reference to the accompanying drawings, in which.

DETAILED DESCRIPTION

Hereinafter, the inventive concept will be explained in detail with reference to the accompanying drawings.

Figure 1:
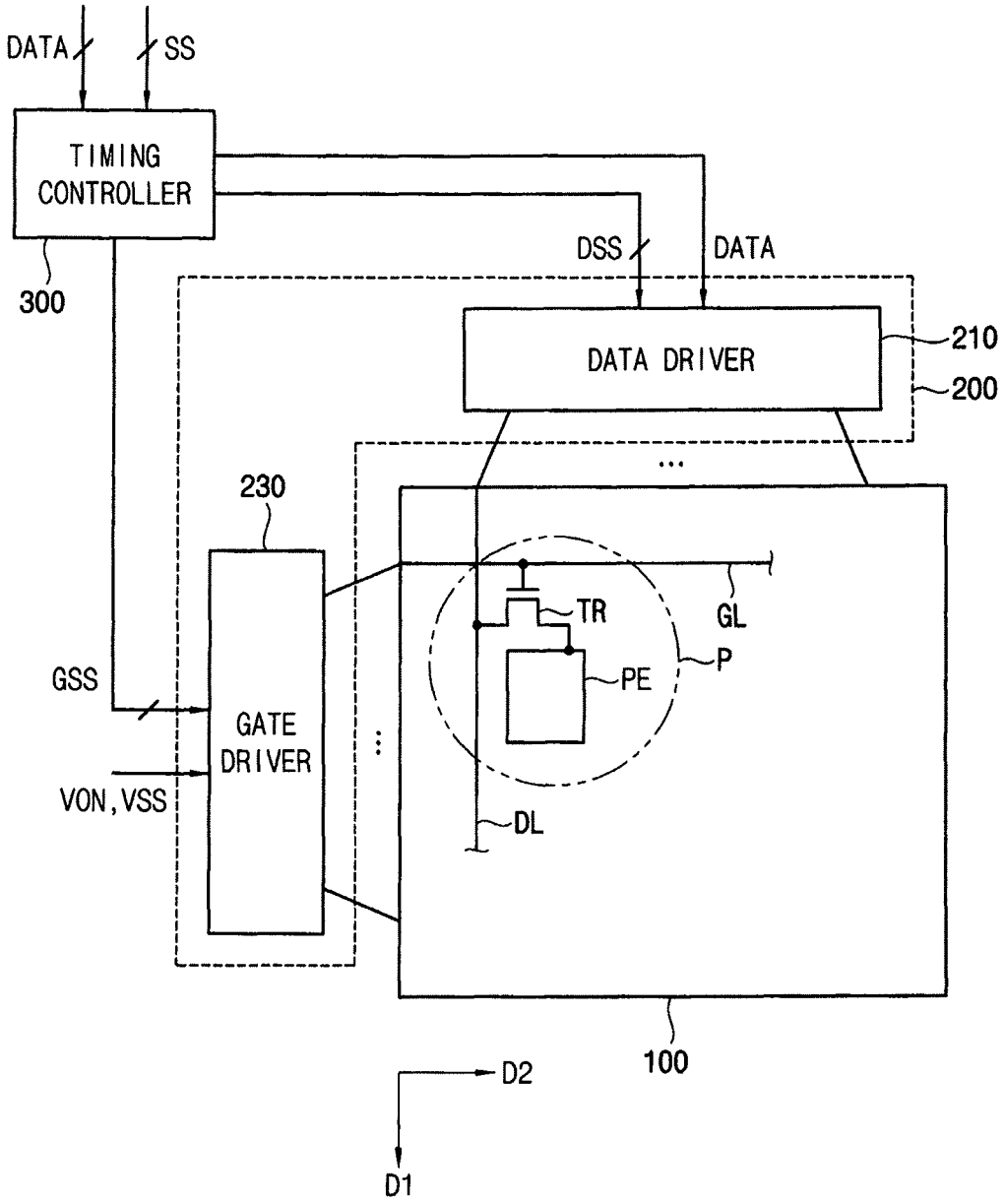
FIG. 1 is a schematic block diagram illustrating a display apparatus according to an exemplary embodiment.

FIG. 1 is a block diagram illustrating a display apparatus according to an exemplary embodiment.

Referring to FIG. 1, the display apparatus may include a display panel 100, a panel driver 200 connected to the display panel for driving the display panel 100, and a timing controller 300 connected to the panel driver for controlling the panel driver 200.

The display panel 100 may includes a plurality of data lines DL, a plurality of gate lines GL and a plurality of sub-pixels P connected between the data and gate lines.

The data lines DL extend in a first direction D1 and are arranged in a second direction D2 crossing the first direction D1. The gate lines GL extend in the second direction D2 and are arranged in the first direction D1. Each of the sub pixels P may include a thin film transistor TR which is connected to a data line DL and a gate line GL, and a pixel electrode PE which is connected to the thin film transistor TR.

The panel driver 200 may include a data driver 210 and a gate driver 230.

The data driver 210 is configured to drive the data lines DL. The data driver 210 is configured to convert a data signal received from the timing controller 300 to a data voltage and to provide the data lines DL with the data voltage based on a data sync signal DSS.

The gate driver 230 is configured to drive the gate lines GL. The gate driver 230 is configured to generate a gate signal having a gate-on voltage VON and a gate-off voltage VSS based on a gate sync signal GSS received from the timing controller 300 and to sequentially provide the gate lines GL with the gate signal.

The timing controller 300 is configured to receive an original sync signal SS and a data signal DATA from an external apparatus.

The timing controller 300 is configured to determine an image mode of a current frame using an image signal of the current frame and an image signal of a previous frame. For example, the timing controller 300 determines whether the image signal of the current frame is a normal image mode or a low-frequency image mode such as a static image.

The timing controller 300 is configured to generate a panel sync signal which may include the data sync signal DSS and the gate sync signal GSS for driving the display panel 100 based on an original sync signal.

For example, when the image mode of the current frame is the normal image mode, the timing controller 300 may be configured to generate the panel sync signal with a normal frequency being same as the normal frequency of the original sync signal. When the image mode of the current frame is the low-frequency image mode, the timing controller 300 is configured to generate the panel sync signal with a low frequency being lower than the normal frequency of the original sync signal. In addition, the timing controller 300 is configured to generate the panel sync signal with a low frequency according to a type of a static image. For example, when the image mode of the current frame is the static image such as a picture, a panel sync signal with a first low frequency may be generated, and when the image mode of the current frame is the static image such as a document, a panel sync signal with a second low frequency being lower than the first low frequency may be generated.

The timing controller 300 is configured to generate a vertical sync signal with the low frequency based on the vertical sync signal being the original sync signal with the normal frequency through a frame masking method. The low frequency may include a divisor frequency of the normal frequency and a non-divisor frequency of the normal frequency. When the normal frequency is 60 Hz, the divisor frequency may be 30 Hz, 20 Hz, 15 Hz, 12 Hz, 10 Hz, 6 Hz, 5 Hz, 4 Hz, 3 Hz and 2 Hz, and the non-divisor frequency may be any frequencies except for the divisor frequency. For example, the non-divisor frequency may be 25 Hz, 17.1 Hz, 13.3 Hz and the like.

Figure 2:
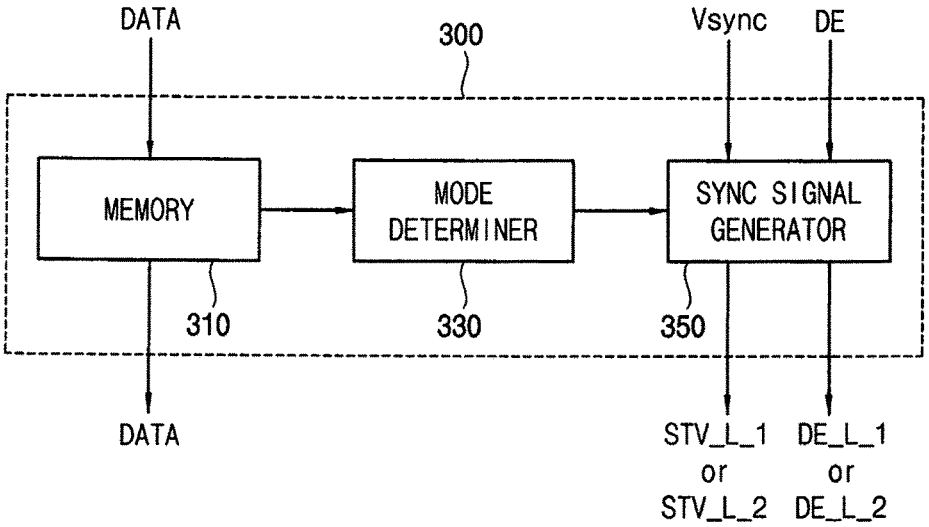
FIG. 2 is a schematic block diagram illustrating a timing controller of FIG. 1.
Figure 3:
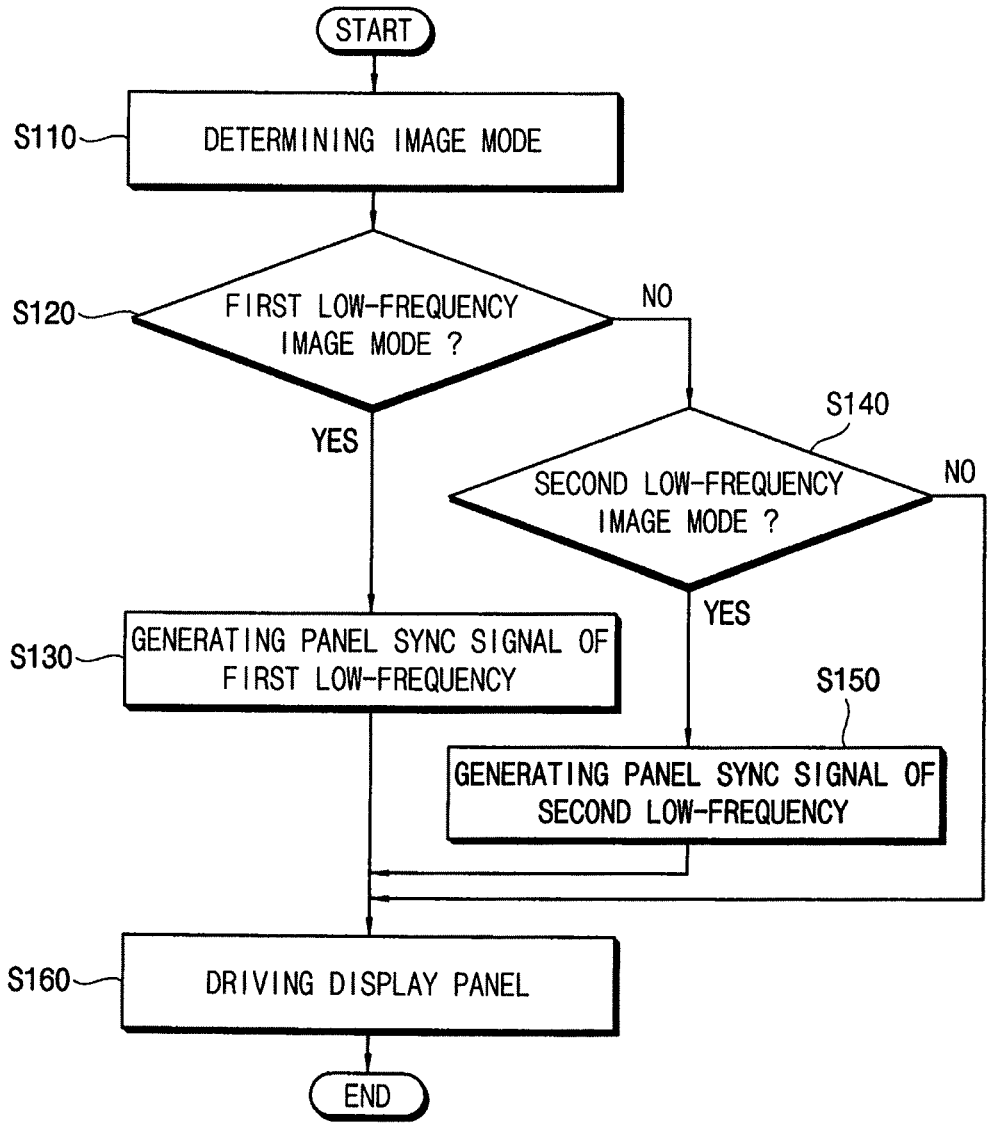
FIG. 3 is a flowchart diagram illustrating a method of driving the display apparatus of FIG. 1.

FIG. 2 is a block diagram illustrating a timing controller of FIG. 1. FIG. 3 is a flowchart illustrating a method of driving the display apparatus of FIG. 1.

Referring to FIGS. 1 to 3, the timing controller 300 may include a memory 310, a mode determiner 330 connected to the memory, and a sync signal generator 350 connected to the mode determiner.

The memory 310 is configured to store the image signal DATA.

The mode determiner 310 is configured to compare the image signal of the previous frame and the image signal of the current frame using the memory 310 and to determine an image mode of the current frame (Step S110).

The sync signal generator 350 is configured to generate a panel sync signal for driving the display panel 100 using the original sync signal, for example, a vertical sync signal Vsync and a data enable signal DE according to the determined image mode.

When the image mode is a first low-frequency image mode (Step S120), the sync signal generator 350 is configured to generate the panel sync signal with the first low frequency (Step S130). For example, the panel sync signal of the first low frequency includes a vertical starting signal STV_L_1 with the first low frequency and a data enable signal DE_L_1 with the first low frequency. The first low frequency may be a non-divisor frequency of the normal frequency and be lower than the normal frequency.

However, when the image mode is a second low-frequency image mode of a second low frequency being lower than the first low frequency of the first low-frequency image mode (Step S140), the sync signal generator 350 is configured to generate a panel sync signal with the second low frequency (Step S150). For example, the panel sync signal of the second low frequency includes a vertical starting signal STV_L_2 with the second low frequency and a data enable signal DE_L_2 with the second low frequency. The second low frequency may be a non-divisor frequency of the normal frequency and be lower than the first low frequency.

When the image mode is the first low-frequency image mode, the data driver 210 and the gate driver 230 are configured to drive the display panel 100 based on the data enable signal DE_L_1 and the vertical starting signal STV_L_1 which are included in the panel sync signal with the first low frequency (Step S160). Thus, the display panel 100 may display an image with the first low frequency.

However, when the image mode is the second low-frequency image mode, the data driver 210 and the gate driver 230 are configured to drive the display panel 100 based on the data enable signal DE_L_2 with the second low frequency and the vertical starting signal STV_L_2 with the second low frequency (Step S160). Therefore, the display panel 100 may display an image with the second low frequency.

Figure 4:
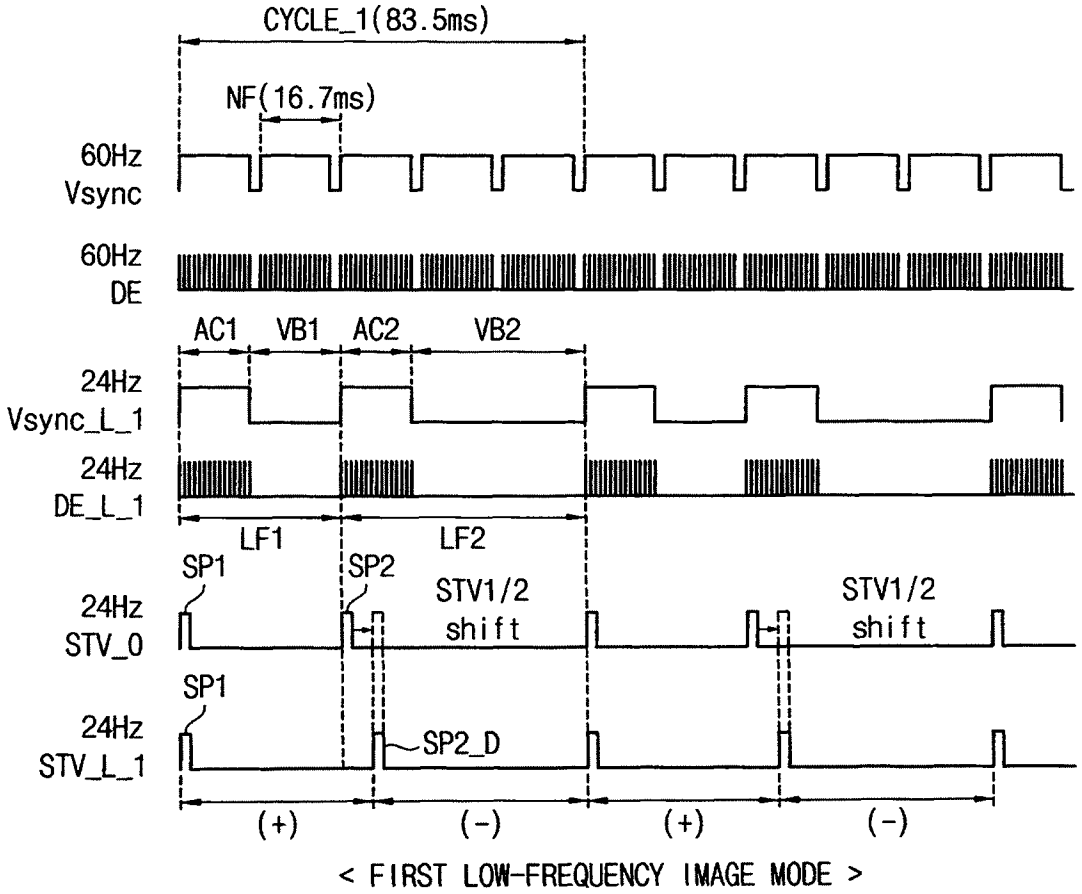
FIG. 4 is a waveform diagram illustrating input and output signals of the timing controller according to an exemplary embodiment.

FIG. 4 is a waveform diagram illustrating input and output signals of the timing controller according to an exemplary embodiment.

Referring to FIGS. 2 and 4, when the image mode of the current frame is the first low-frequency image mode, the mode determiner 330 is configured to provide the sync signal generator 350 with mode information corresponding to the first low-frequency image mode.

The sync signal generator 350 is configured to generate the panel sync signal with the first low frequency using the original sync signal with the normal frequency according to the mode information.

As shown in FIG. 4, the normal frequency is 60 Hz and the first low frequency is a non-divisor frequency of 60 Hz. For example, the first low frequency may be 24 Hz.

The sync signal generator 350 is configured to generate a vertical sync signal Vsync_L_1 with the 24 Hz first low frequency based on a vertical sync signal Vsync of 60 Hz through a frame masking method.

According to the exemplary embodiment, the non-divisor frequency of the normal frequency may be defined as in the following Expression 1.

$$\text{Low_freq(Hz)}=\{Nor_\text{freq(Hz)}\times N\}/K \qquad \text{Expression 1}$$

Wherein, 'Low_freq' is a low frequency (Hz), 'Nor_freq' is a normal frequency (Hz), is the number of cyclic periods of a normal sync signal included in one cyclic period of a low-frequency sync signal, and 'N' is the number of active periods included in one cyclic period of the low-frequency sync signal.

Referring to Expression 1, 'Low_freq' may be 24 Hz, 'Nor_freq' may be 60 Hz, 'N' may be referred to as 2 and 'K' may be referred to as 5, but they are not limited thereto.

The vertical sync signal Vsync of 60 Hz has a normal frame period NF of 16.7 ms. The vertical sync signal Vsync_L_1 of the first low frequency corresponds to 5 normal frame periods (16.7 ms×5=83.5 ms) based on the vertical sync signal Vsync of 60 Hz and has a first frame period LF1 (16.7 ms×2=33.4 ms) and a second frame period LF2 (16.7 ms×3=50.1 ms). The first frame period LF1 may correspond to 2 normal frame periods (16.7 ms×2) and the second frame period LF2 may correspond to 3 normal frame periods (16.7 ms×3).

The first frame period LF1 may include a first active period AC1 corresponding to one normal frame period (1NF) and a first vertical blanking period VB1 corresponding to one normal frame period (1NF). The second frame period LF2 may include a second active period AC2 corresponding to one normal frame period (1NF) and a second vertical blanking period VB2 corresponding to 2 normal frame periods (2NF).

The sync signal generator 350 is configured to generate a data enable signal DE_L_1 with the first low frequency based on the vertical sync signal Vsync_L_1 with the first low frequency. The data enable signal DE_L_1 of the first low frequency is activated in the first active period AC1 of the first frame period LF1 and is deactivated in the first vertical blanking period VB1 of the first frame period LF1. The data enable signal DE_L_1 of the first low frequency is activated in the second active period AC2 of the second frame period LF2 and is deactivated in the second vertical blanking period VB2 of the second frame period LF2.

The sync signal generator 350 is configured to generate a reference vertical starting signal STV_O synchronized with the vertical sync signal Vsync_L_1 of the first low frequency. The reference vertical starting signal STV_O includes a first starting pulse SP1 which is raised at a start timing of the first frame period LF1 and a second starting pulse SP2 which is raised at a start timing of the second frame period LF2.

The sync signal generator 350 is configured to shift a raising timing of the second starting pulse SP2 to a half point of one cyclic period CYCLE_1 corresponding to 5 normal frame periods (5NF). For example, the second starting pulse SP2 is shifted by about ½ of the normal frame period NF from the start timing of the second frame period LF2. The first starting pulse SP1 and the second delay starting pulse SP2_D have a same cyclic period as each other.

The sync signal generator 350 is configured to generate a vertical starting signal STV_L_1 with the first low frequency, which includes the first starting pulse SP1 and a second delay starting pulse SP2_D.

The vertical starting signal STV_L_1 of the first low frequency is applied to the gate driver 230. The gate driver 230 is configured to output the gate signal to the display panel 100 in synchronization with the vertical starting signal STV_L_1 with the first low frequency.

The image signal synchronized with the data enable signal DE_L_1 of the first low frequency is applied to the data driver 210, and the data driver 210 is configured to output a data voltage synchronized with the gate signal outputted from the gate driver 230 to the display panel 100.

A charging time of the data voltage outputted to the display panel 100 in synchronization with the first starting pulse SP1 of the first frame period LF1 may be substantially the same as a charging time of the data voltage outputted to the display panel 100 in synchronization with the second delay starting pulse SP2_D of the second frequency frame period LF2. Thus, in the display panel 100 driving with a frame-inversion mode, charging-period difference between data voltages having positive and negative polarities with respect to a reference voltage by a difference between the first and second frame periods LF1 and LF2, may be compensated.

Figure 5:
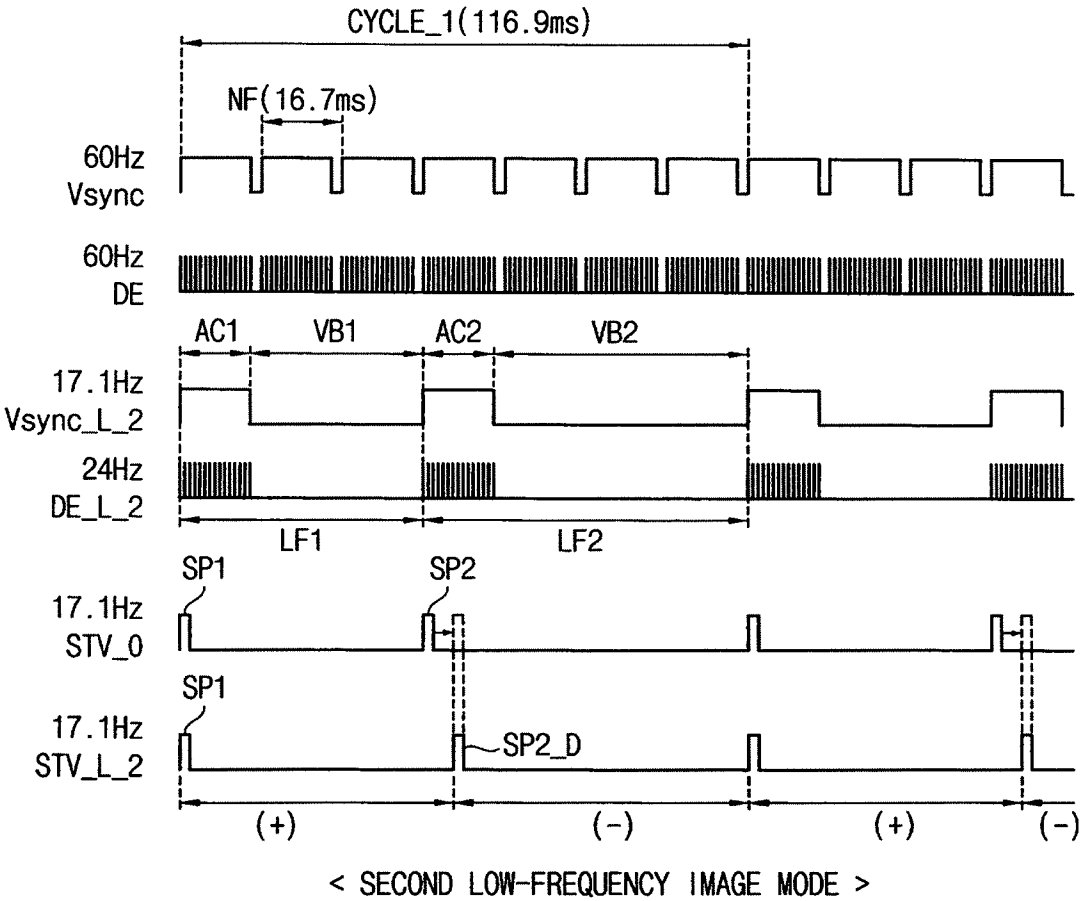
FIG. 5 is a waveform diagram illustrating input and output signals of the timing controller according to an exemplary embodiment.

FIG. 5 is a waveform diagram illustrating input and output signals of the timing controller according to an exemplary embodiment.

Referring to FIGS. 2 and 5, when the image mode of the current frame is the second low-frequency image mode, the mode determiner 330 is configured to provide the sync signal generator 350 with mode information corresponding to the second low-frequency image mode.

The sync signal generator 350 is configured to generate the panel sync signal with the second low frequency using the original sync signal with the normal frequency according to the mode information.

As shown in FIG. 5, the normal frequency may be 60 Hz and the second low frequency may be a non-divisor frequency of 60 Hz. Moreover, the second low frequency may be a non-divisor of the first low frequency. For example, the second low frequency may be 17.1 Hz.

The sync signal generator 350 is configured to generate a vertical sync signal Vsync_L_2 with the second low frequency of 17.1 Hz based on a vertical sync signal Vsync of 60 Hz through a frame masking method. The vertical sync signal Vsync of 60 Hz has a normal frame period NF of 16.7 ms.

The vertical sync signal Vsync_L_2 of the second low frequency corresponds to 7 normal frame periods (16.7 ms×7=116.9 ms) based on the vertical sync signal Vsync of 60 Hz and has a first frame period LF1 (50.1 ms) and a second frame period LF2 (66.8 ms). The first frame period LF1 may correspond to 3 normal frame periods (16.7 ms×3) and the second frame period LF2 may correspond to 4 normal frame periods (16.7 ms×4).

The first frame period LF1 may include a first active period AC1 corresponding to one normal frame period (1NF) and a first vertical blanking period VB1 corresponding to 2 normal frame periods (2NF). The second frame period LF2 may include a second active period AC2 corresponding to one normal frame period (1NF) and a second vertical blanking period VB2 corresponding to 3 normal frame periods (3NF).

The sync signal generator 350 is configured to generate a data enable signal DE_L_2 with the second low frequency based on the vertical sync signal Vsync_L_2 of the second low frequency. The data enable signal DE_L_2 of the second low frequency is activated in the first active period AC1 of the first frame period LF1 and is deactivated in the first vertical blanking period VB1 of the first frame period LF1. The data enable signal DE_L_2 of the second low frequency is activated in the second active period AC2 of the second frame period LF2 and is deactivated in the second vertical blanking period VB2 of the second frame period LF2.

The sync signal generator 350 is configured to generate a reference vertical starting signal STV_O synchronized with the vertical sync signal Vsync_L_2 of the second low frequency. The reference vertical starting signal STV_O includes a first starting pulse SP1 which is raised at a start timing of the first frame period LF1 and a second starting pulse SP2 which is raised at a start timing of the second frame period LF2.

The sync signal generator 350 is configured to shift a raising timing of the second starting pulse SP2 to a half point of one cyclic period CYCLE_1 corresponding to 7 normal frame periods (7×NF). For example, the second starting pulse SP2 is shifted by about ⅓ of the normal frame period NF from the start timing of the second frame period LF2.

The sync signal generator 350 is configured to generate a vertical starting signal STV_L_2 with the second low frequency, which includes the first starting pulse SP1 and a second delay starting pulse SP2_D.

The vertical starting signal STV_L_2 of the second low frequency is applied to the gate driver 230. The gate driver 230 is configured to output the gate signal to the display panel 100 in synchronization with the vertical starting signal STV_L_2 of the second low frequency.

The image signal synchronized with the data enable signal DE_L_2 of the second low frequency is applied to the data driver 210 and the data driver 210 is configured to output a data voltage synchronized with the gate signal outputted from the gate driver 230, to the display panel 100.

A charging time of the data voltage outputted to the display panel 100 in synchronization with the first starting pulse SP1 of the first frame period LF1 may be substantially the same as a charging time of the data voltage outputted to the display panel 100 in synchronization with the second delay starting pulse SP2_D of second frequency frame period LF2. Thus, in the display panel 100 driving with a frame-inversion mode, charging-period difference between data voltages of positive and negative polarities by a difference between the first and second frame periods LF1 and LF2, may be compensated.

Figure 6:
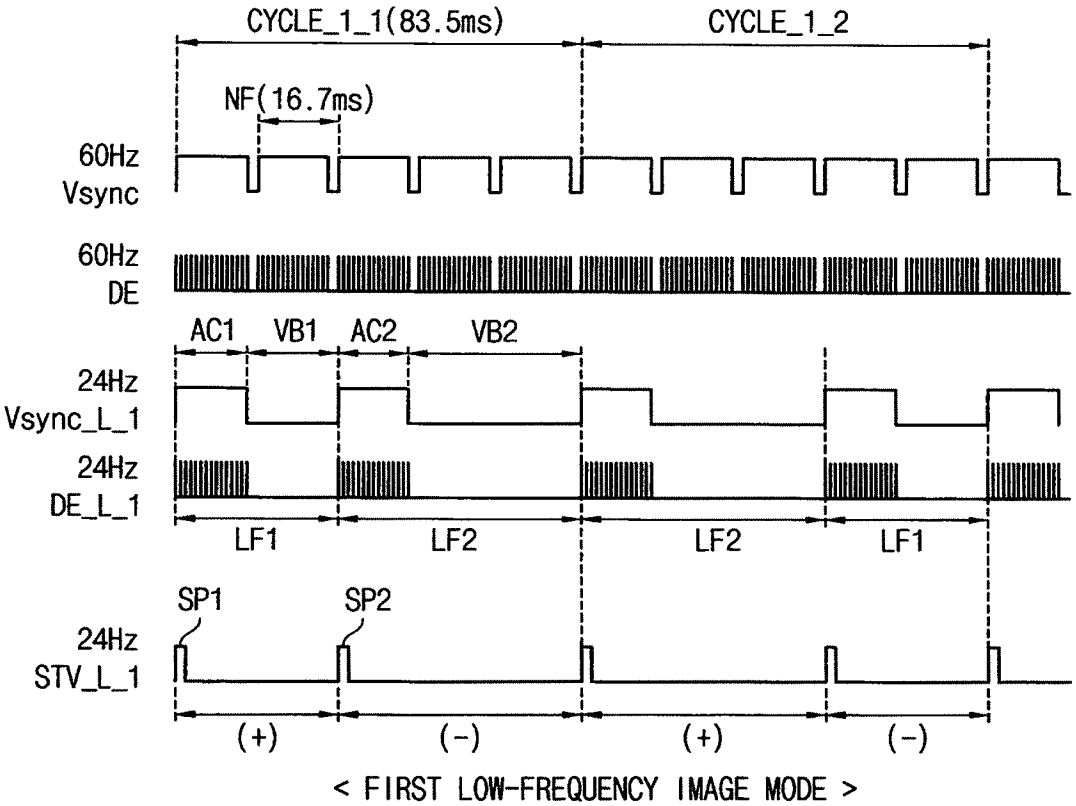
FIG. 6 is a waveform diagram illustrating input and output signals of the timing controller according to an exemplary embodiment.

FIG. 6 is a waveform diagram illustrating input and output signals of the timing controller according to an exemplary embodiment.

Referring to FIGS. 2 and 6, when the image mode of the current frame is the first low-frequency image mode, the mode determiner 330 is configured to provide the sync signal generator 350 with mode information corresponding to the first low-frequency image mode.

The sync signal generator 350 is configured to generate the panel sync signal with the first low frequency using the original sync signal with the normal frequency according to the mode information.

As shown in FIG. 6, the normal frequency is 60 Hz and the first low frequency is a non-divisor frequency of 60 Hz. For example, the first low frequency may be 24 Hz.

The sync signal generator 350 is configured to generate a vertical sync signal Vsync_L_1 with the first low frequency of 24 Hz based on a vertical sync signal Vsync of 60 Hz through a frame masking method. The vertical sync signal Vsync of 60 Hz has a normal frame period NF of 16.7 ms.

The vertical sync signal Vsync_L_1 of the first low frequency corresponds to 5 normal frame periods (16.7 ms×5=83.5 ms) based on the vertical sync signal Vsync of 60 Hz and has a first frame period LF1 (33.4 ms) and a second frame period LF2 (50.1 ms). The first frame period LF1 may correspond to 2 normal frame periods (16.7 ms×2) and the second frame period LF2 may correspond to 3 normal frame periods (16.7 ms×3).

The first frame period LF1 may include a first active period AC1 corresponding to one normal frame period (1 NF) and a first vertical blanking period VB1 corresponding to one normal frame period (1 NF). The second frame period LF2 may include a second active period AC2 corresponding to one normal frame period (1 NF) and a second vertical blanking period VB2 corresponding to 2 normal frame periods (2 NF).

According to the exemplary embodiment, the vertical sync signal Vsync_L_1 of the first low frequency includes the first frame period LF1 and second frame period LF2 which are sequentially arranged in a first order during a first cyclic period CYCLE_1_1, and the second frame period LF2 and the first frame period LF1 which are sequentially arranged in a second order opposite to the first order during a second cyclic period CYCLE_1_2. For example, the first and second frame periods LF1 and LF2 are repeated by an order such as the first, second, second and first frame periods LF1, LF2, LF2 and LF1.

For example, referring to a data voltage charged in a sub pixel, a data voltage of the positive polarity is charged in the sub pixel during the first frame period LF1 of the first cyclic period CYCLE_1_1, and a data voltage of a negative polarity is charged in the sub pixel during the second frame period LF2 of the first cyclic period CYCLE_1_1. Thus, a charging time of the data voltage having the negative polarity is longer than a charging time of the data voltage having the positive polarity during the first cyclic period CYCLE_1_1. However, a data voltage having the positive polarity is charged in the sub pixel during the second frame period LF2 of the second cyclic period CYCLE_1_2, and a data voltage having the negative polarity is charged in the sub pixel during the first frame period LF1 of the second cyclic period CYCLE_1_2. Thus, a charging time of the data voltage having the positive polarity is longer than a charging time of the data voltage having the negative polarity during the second cyclic period CYCLE_1_2. Therefore, charging times of data voltages having the positive and negative polarities may be substantially the same as each other during a sum period of the first and second cyclic periods CYCLE_1_1 and CYCLE_1_2.

According to the exemplary embodiment, a charging-period difference between data voltages of positive and negative polarities may be balanced by a difference between the first and second frame periods LF1 and LF2, which may be compensated by an arrangement of the first and second frame periods LF1 and LF2 in the vertical sync signal Vsync_L_1 of the first low frequency.

The sync signal generator 350 is configured to generate a data enable signal DE_L_1 with the first low frequency based on the vertical sync signal Vsync_L_1 of the first low frequency. The data enable signal DE_L_1 of the first low frequency is activated in the first active period AC1 of the first frame period LF1 and is deactivated in the first vertical blanking period VB1 of the first frame period LF1. The data enable signal DE_L_1 of the first low frequency is activated in the second active period AC2 of the second frame period LF2 and is deactivated in the second vertical blanking period VB2 of the second frame period LF2.

The sync signal generator 350 is configured to generate a vertical starting signal STV_L_1 with the first low frequency synchronized with the vertical sync signal Vsync_L_1 of the first low frequency. The vertical starting signal STV_L_1 of the first low frequency includes a first starting pulse SP1 which is raised at a start timing of the first frame period LF1 and a second starting pulse SP2 which is raised at a start timing of the second frame period LF2.

The vertical starting signal STV_L_1 of the first low frequency is applied to the gate driver 230. The gate driver 230 is configured to output the gate signal to the display panel 100 in synchronization with the vertical starting signal STV_L_1 of the first low frequency.

The image signal synchronized with the data enable signal DE_L_1 of the first low frequency is applied to the data driver 210, and the data driver 210 is configured to output a data voltage synchronized with the gate signal outputted from the gate driver 230 to the display panel 100.

Figure 7:
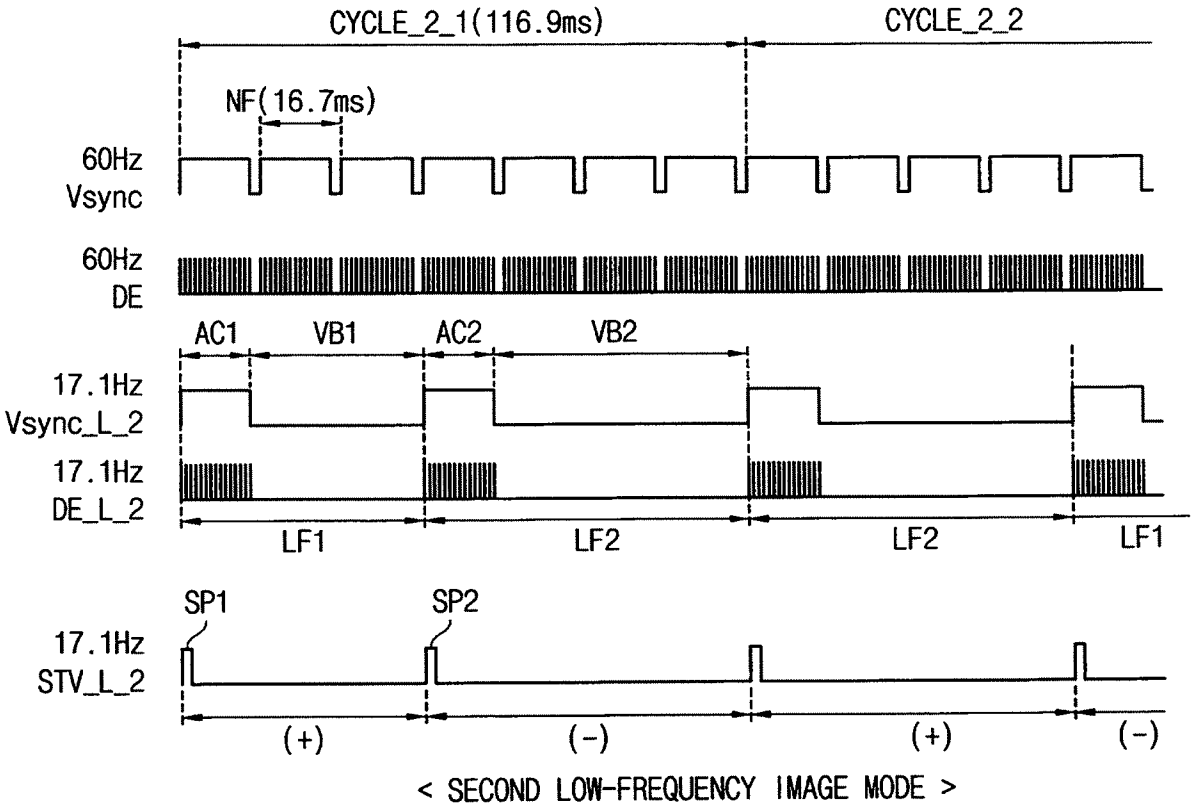
FIG. 7 is a waveform diagram illustrating input and output signals of the timing controller according to an exemplary embodiment.

FIG. 7 is a waveform diagram illustrating input and output signals of the timing controller according to an exemplary embodiment.

Referring to FIGS. 2 and 7, when the image mode of the current frame is the second low-frequency image mode, the mode determiner 330 is configured to provide the sync signal generator 350 with mode information corresponding to the second low-frequency image mode.

The sync signal generator 350 is configured to generate the panel sync signal with the second low frequency using the original sync signal with the normal frequency based on the mode-information.

As shown in FIG. 7, the normal frequency is 60 Hz and the second low frequency is a non-divisor frequency of 60 Hz. For example, the second low frequency may be 17.1 Hz.

The sync signal generator 350 is configured to generate a vertical sync signal Vsync_L_2 with 17.1 Hz of the second low frequency based on a vertical sync signal Vsync of 60 Hz through a frame masking method. The vertical sync signal Vsync of 60 Hz has a normal frame period NF of 16.7 ms.

The vertical sync signal Vsync_L_2 of the second low frequency corresponds to 7 normal frame periods (16.7 ms×7=116.9 ms) based on the vertical sync signal Vsync of 60 Hz and has a first frame period LF1 (50.1 ms) and a second frame period LF2 (66.8 ms). The first frame period LF1 may correspond to 3 normal frame periods (16.7 ms×3) and the second frame period LF2 may correspond to 4 normal frame periods (16.7 ms×4).

The first frame period LF1 may include a first active period AC1 corresponding to one normal frame period (1NF) and a first vertical blanking period VB1 corresponding to 2 normal frame periods (2NF). The second frame period LF2 may include a second active period AC2 corresponding to one normal frame period (1NF) and a second vertical blanking period VB2 corresponding to 3 normal frame periods (3 NF).

According to the exemplary embodiment, the vertical sync signal Vsync_L_2 of the second low frequency includes the first frame period LF1 and second frame period LF2 which are sequentially arranged in a first order during a first cyclic period CYCLE_2_1, and the second frame period LF2 and the first frame period LF1 which are sequentially arranged in a second order opposite to the first order during a second cyclic period CYCLE_2_2. For example, the first and second frame periods LF1 and LF2 are repeated by an order such as the first, second, second and first frame periods LF1, LF2, LF2 and LF1.

Referring to a data voltage charged in a sub pixel, a data voltage of the positive polarity may be charged in the sub pixel during the first frame period LF1 of the first cyclic period CYCLE_2_1, and a data voltage of a negative polarity is charged in the sub pixel during the second frame period LF2 of the first cyclic period CYCLE_2_1. Thus, a charging time of the data voltage having the negative polarity is longer than a charging time of the data voltage having the positive polarity during the first cyclic period CYCLE_2_1. However, a data voltage having the positive polarity is charged in the sub pixel during the second frame period LF2 of the second cyclic period CYCLE_2_2, and a data voltage having the negative polarity is charged in the sub pixel during the first frame period LF1 of the second cyclic period CYCLE_2_2. Thus, a charging time of the data voltage having the positive polarity is longer than a charging time of the data voltage having the negative polarity during the second cyclic period CYCLE__ 2_2. Therefore, charging times of data voltages having the positive and negative polarities may be substantially the same as each other during a sum period of the first and second cyclic periods CYCLE_2_1 and CYCLE_2_2.

According to the exemplary embodiment, a charging-period difference between data voltages of positive and negative polarities may be balanced by a difference between the first and second frame periods LF1 and LF2, which may be compensated by an arrangement of the first and second frame periods LF1 and LF2 in the vertical sync signal Vsync_L_2 of the second low frequency.

The sync signal generator 350 is configured to generate a data enable signal DE_L_2 with the second low frequency based on the vertical sync signal Vsync_L_2 of the second low frequency. The data enable signal DE_L_2 of the second low frequency is activated in the first active period AC1 of the first frame period LF1 and is deactivated in the first vertical blanking period VB1 of the first frame period LF1. The data enable signal DE_L_2 of the second low frequency is activated in the second active period AC2 of the second frame period LF2 and is deactivated in the second vertical blanking period VB2 of the second frame period LF2.

The sync signal generator 350 is configured to generate a vertical starting signal STV_L_2 of the second low frequency synchronized with the vertical sync signal Vsync_L_2 of the second low frequency. The vertical starting signal STV_L_2 of the second low frequency includes a first starting pulse SP1 which is raised at a start timing of the first frame period LF1 and a second starting pulse SP2 which is raised at a start timing of the second frame period LF2.

The vertical starting signal STV_L_2 of the second low frequency is applied to the gate driver 230. The gate driver 230 is configured to output the gate signal to the display panel 100 in synchronization with the vertical starting signal STV_L_2 of the second low frequency.

The image signal synchronized with the data enable signal DE_L_2 of the second low frequency is applied to the data driver 210, and the data driver 210 is configured to output a data voltage synchronized with the gate signal outputted from the gate driver 230 to the display panel 100.

As described above, according to exemplary embodiments, the display apparatus is configured to generate a non-divisor frequency, which is not a divisor frequency of the normal frequency of the original sync signal and lower than the normal frequency. Thus, the display apparatus may be configured to generate a low-frequency sync signal with a suitable low frequency corresponding to a type of a static or slowly-changing image.

In addition, when the low-frequency sync signal includes a plurality of frame periods having different periods from each other, the display apparatus is configured to generate the vertical starting signal having a regular interval between starting pulses. Thus, charging-period differences between data voltages of positive and negative polarities according to a difference between the frame periods may be compensated. Alternatively, the charging-period difference between data voltages of positive and negative polarities may be compensated by controlling an arrangement of the plurality of frame periods according to a frame inversion mode.

The foregoing is illustrative of the inventive concept and is not to be construed as limiting thereof. Although exemplary embodiments of the inventive concept have been described, those of ordinary skill in the pertinent art will readily appreciate that many modifications are possible in the exemplary embodiments without materially departing from the novel teachings and advantages of the inventive concept. Accordingly, all such modifications are intended to be included within the scope of the inventive concept as defined in the claims. Therefore, it is to be understood that the foregoing is illustrative of the inventive concept and is not to be construed as limited to the specific exemplary embodiments disclosed, and that modifications to the disclosed exemplary embodiments, as well as other embodiments, are intended to be included within the scope of the appended claims. The inventive concept is defined by the following claims, with equivalents of the claims to be included therein.

What is claimed is:

1. A display apparatus comprising:

a mode determiner configured to compare image signals of a previous frame and a current frame and to determine an image mode of the current frame;

a sync signal generator configured to generate a panel sync signal with a low frequency corresponding to the image mode using an original sync signal with a normal frequency, the low frequency being a non-divisor frequency of the normal frequency and lower than the normal frequency;

a data driver configured to drive a data line of a display panel using a data sync signal based on the panel sync signal with the low frequency; and a gate driver configured to drive a gate line of the display panel using a gate sync signal based on the panel sync signal with the low frequency, wherein the sync signal generator is configured to generate a vertical sync signal with the low frequency based on a vertical sync signal with the normal frequency, and the vertical sync signal with the low frequency has a first frame period and a second frame period different from the first frame period, and wherein the first frame period and the second frame period have an active period the same as each other and a vertical blanking period different from each other.

2. The display apparatus of claim 1, wherein the sync signal generator is configured to generate a low-frequency data enable signal activated respectively corresponding to the active period of the first and second frames.

3. The display apparatus of claim 1, wherein the sync signal generator is configured to generate a reference vertical sync signal having a first starting pulse corresponding to the first frame period and a second starting pulse corresponding to the second frame period, and to generate a low-frequency vertical starting signal having a first starting pulse and a second starting pulse, one of the first and second starting pulses of the low-frequency vertical starting signal shifted from a corresponding pulse of the reference vertical sync signal.

4. The display apparatus of claim 3, wherein the first and second starting pulses of the low-frequency vertical starting signal are repeated by a substantially same period as each other.

5. The display apparatus of claim 3, wherein the gate driver starts an operation in response to the low-frequency vertical starting signal.

6. The display apparatus of claim 1, wherein the low-frequency vertical sync signal has the first frame period and the second frame period, and the first and second frame periods are repeated in an order of the first, second, second and first frame periods, respectively.

7. The display apparatus of claim 5, wherein the data driver is configured to output a data voltage which swings between a positive polarity and a negative polarity opposite to the positive polarity with respect to a reference voltage.

8. A method of driving a display apparatus comprising:

determining an image mode of a current frame using image signals of a previous frame and the current frame;

generating a panel sync signal with a low frequency corresponding to the image mode using an original sync signal with a normal frequency, the low frequency being a non-divisor frequency of the normal frequency and being lower than the normal frequency;

driving a data line of a display panel using a data sync signal based on the panel sync signal with the low frequency; and driving a gate line of the display panel using a gate sync signal based on the panel sync signal with the low frequency, further comprising:

generating a vertical sync signal with the low frequency base on a vertical sync signal with the normal frequency, wherein the vertical sync signal with the low frequency has a first frame period and a second frame period different from the first frame period, and wherein the first frame period and the second frame period have an active period the same as each other and a vertical blanking period different from each other.

9. The method of claim 8, further comprising generating a low-frequency data enable signal activated respectively corresponding to the active period of the first and second frames.

10. The method of claim 8, further comprising:

generating a reference vertical sync signal having a first starting pulse corresponding to the first frame period and a second starting pulse corresponding to the second frame period, and generating a low-frequency vertical starting signal having a first starting pulse and a second starting pulse, one of the first and second starting pulses of the low-frequency vertical starting signal shifted from a corresponding pulse of the reference vertical sync signal.

11. The method of claim 10, wherein the first and second starting pulses of the low-frequency vertical starting signal are repeated with a same period.

12. The method of claim 8, wherein the low-frequency vertical sync signal has the first frame period and the second frame period, and the first and second frame periods are repeated in an order as the first, second, second and first frame periods, respectively.

13. The method of claim 12, further comprising:

outputting a data voltage which swings between a positive polarity and a negative polarity opposite to the positive polarity with respect to a reference voltage, to the data line.

14. A timing controller for an image display apparatus, the timing controller comprising:

an image data input configured to receive a plurality of original image frames;

a memory coupled to the image data input;

a mode determiner coupled to the memory and configured to receive present frame image data from at least one of the image data input or the memory, retrieve previous frame image data from the memory, compare the present frame image data with the previous frame image data to determine whether one of a plurality of low frequencies is achievable, and generate mode information indicative of a low frequency corresponding to a substantially lowest achievable frequency of the plurality of low frequencies; and a sync signal generator connected to the mode determiner and configured to receive the mode information, generate at least one of a start signal or a data enable signal, and output the at least one generated signal, wherein the sync signal generator is configured to generate a vertical sync signal with the low frequency based on a vertical sync signal with the normal frequency, and the vertical sync signal with the low frequency has a first frame period and a second frame period different from the first frame period, and wherein the first frame period and the second frame period have an active period the same as each other and a vertical blanking period different from each other.

15. The timing controller of claim 14, further comprising at least one of a synchronization signal input or a data enable signal input coupled to the sync signal generator.

16. The timing controller of claim 14, wherein the image data input is configured to receive original image data having an original frame frequency, the mode determiner is configured to generate mode information indicative of a low frequency corresponding to a frame frequency lower than the original frame frequency, where the original frame frequency may be unequally divisible by the low frequency, and the sync signal generator is configured to generate a synchronization signal corresponding to the low frequency by at least one of adjusting a start time of one of a plurality of alternating sub-frames within each frame or inverting an order of alternating sub-frames within each frame.

* * * * *